US005785479A

United States Patent [19]

Battisti et al.

[11] Patent Number: 5,785,479

[45] Date of Patent: Jul. 28, 1998

[54] AUTOMATED SPIRAL BINDING MACHINE

[75] Inventors: Thomas Battisti, Buffalo Grove; Adam Horwitz, Chicago; Robert E. Slater, Cary, all of Ill.

[73] Assignee: General Binding Corporation, Northbrook, Ill.

[21] Appl. No.: 620,677

[22] Filed: Mar. 26, 1996

[51] Int. Cl.[6] ..... B42B 5/10

[52] U.S. Cl. ..... 412/39; 412/38

[58] Field of Search ..... 412/39, 40, 38, 412/33, 1, 6, 7, 9; 140/92.2, 92.7, 92.9, 92.93

[56] References Cited

U.S. PATENT DOCUMENTS

| | | | |
|---|---|---|---|
| 2,101,804 | 12/1937 | Bidwell | 140/92.93 |
| 2,961,012 | 11/1960 | Freundlich | 140/92.7 |
| 2,995,157 | 8/1961 | Catini | 140/92.7 |
| 3,193,136 | 7/1965 | Stumpf et al. | 140/92.7 |
| 3,568,729 | 3/1971 | Freundlich et al. . | |
| 3,592,242 | 7/1971 | Sickinger . | |
| 4,095,623 | 6/1978 | Lemburg et al. . | |
| 4,153,081 | 5/1979 | Lemburg et al. . | |
| 4,253,499 | 3/1981 | Lemburg et al. . | |
| 4,378,822 | 4/1983 | Morris . | |
| 4,501,304 | 2/1985 | Lehmann . | |

*Primary Examiner*—Willmon Fridie, Jr.
*Attorney, Agent, or Firm*—Hill & Simpson

[57] ABSTRACT

A machine is disclosed for withdrawing a spiral coil from a prepacked cartridge set of coils and spirally feeding that coil to a coil guide. A stack of sheets having prepunched holes along a side edge thereof is located so that its prepunched holes are aligned with the coil guide. A rotatable drive roller, proximate the coil guide, engages the withdrawn coil and spirally feeds the coil through the coil guide, such that the spirals of the coil sequentially pass through the prepunched holes. After the lead end of the coil has passed through the prepunched holes of the stack of sheets, it is crimped. The drive roller then reverses direction to spirally feed the coil backwards through the coil guide, whereupon the tail end of the coil is crimped. The movements in the machine are designed to vary dependent upon size of the coil.

30 Claims, 5 Drawing Sheets

AUTOMATED SPIRAL BINDING MACHINE

CROSS-REFERENCE TO RELATED APPLICATION

In the description of the preferred embodiment of this invention, a supply of spiral coil elements is furnished in the form of a box cartridge. Such a cartridge arrangement for providing a plurality of like-size coils is also the subject of commonly assigned application Ser. No. 08/620,673 (Attorney Docket No. P95,1631(A)), filed concurrently herewith on behalf of Roger Scharer and entitled "Coded Coil Element Cartridge" now U.S. Pat. No. 5,669,747.

BACKGROUND OF THE INVENTION

The invention relates to a binding machine for paper sheets in which a spiral coil is fed through prepunched holes in the sheets; however, this invention presents an automated system enabling mechanized application of such coils to respective sheet stacks, and affixing such spiral coils to the associated sheet stacks. The inventive machine is usable with various diameters of spiral coils.

In prior art machines of this type, as exemplified by U.S. Pat. No. 4,378,822, issued Apr. 5, 1983, spiral binding has been accomplished by directing a spiral coil over a drive wheel which is disposed approximate one edge of the stack of sheets to be bound. A critical difficulty in this type of arrangement is reliably guiding the spiral feed of the coil along the length and through the punched holes in the sheets. In the U.S. Pat. No. '822, a mandrel guides the coil; however, this mandrel is not proximate the sheet stack such that the coil is only fed along the mandrel until the coil actually commences to spirally engage in the punched holes of the sheets. Another device that has been used to guide the feed of a spiral coil into engagement with the punched holes in a stack of sheets is a coiling tool, such as described in U.S. Pat. No. 3,592,242, issued Jul. 13, 1971. The coiling tool has a mandrel surrounded by a slotted member. Wire enters the slotted member at one end, is coiled by the mandrel, and exits at the other end of the tool in the form of a spiral wire which, as it turns, is to pass successively through the series of punched holes in a sheet stack. Fixed guide members are disposed along the length of the punched hole edge of the sheets to control the movement of the spiral wire as it spirally winds through the holes in the sheets. The possibilities for jamming or misthreading due to tension build-up along the spiral wire are not addressed by these machines.

To applicant's knowledge, there has never been a commercially recognized automated spiral coil binding machine for paper sheets which both successively applies and locks spiral binding elements. The present invention is intended and expected to make such a device possible.

SUMMARY OF THE INVENTION

For use in the spiral coil binding system of the present invention, there is provided a box-like cartridge containing a number of individual spiral coil elements. The box contains a barcode label designating the particular size, preferably in terms of diameter, of the coils contained in the cartridge. The cartridge box containing the coils is formed with cut-out sections exposing portions of each coil length.

An automated coil loader is adapted for receiving the coil cartridge. The loader device has a barcode reader, which reports to the microprocessor controlling the machine drive system so that drive system movements correlate to the coil size being used. For aligning with the cut-out portions of the cartridge box, the loader coil has a coil sensor and feed roller. The sensor and feed roller are aligned relative to a length of coil in the box. The sensor determines if the cartridge box has to be indexed to bring into alignment with the feed roller a coil length, or whether a coil length currently overlies the feed roller.

A semi-automatic coil binding mechanism is formed on one end with an exposed horizontal platform and at the other end with a vertically raised binding station. An appropriate stack of sheets having prepunched holes is placed on the platform, registered by a pair of curved pins extending upward through which the operator threads associated holes in the sheet stack. The pins retract; and then the platform moves the sheet stack forward into the binding station. In the binding station, a coil guide and a drive roller move into position approximate the punched hole edge of the sheet stack in preparation for receiving the feed of a coil element, such as from the loader device. In the binding station, the drive roller rotates to engage the fed coil and spirally drive the coil the length of the punched holes edge of the sheet stack. At the end of the punched hole edge of the sheet stack, the lead end of the coil enters a crimper post slot and then hits a limit switch associated with the lead end crimp post.

The lead end crimp post limit switch being contacted by the coil element triggers the drive roller to stop, the drive roller to press in against the coil and the coil guide to clamp the coil, and the crimper post to rotate and descend, permanently deforming the lead coil end. The coil is then released, and a tail end coil crimper raises up, behind the coil. The drive roller reverses its feed direction, and passes the tail end of the coil back through this crimper's post slot until engaging this crimper's limit switch. The tail end of the coil is then deformed in the same fashion as the lead end.

The binding station has completed its operation. The coil guide and drive roller mechanisms retract and withdraw from the punched hole edge of the sheet stack. The platform reverses to bring the now bound sheet stack back out to the front end of the coil binding machine. The operator then removes the bound stack and inserts a new sheet stack to be bound by repetition of the above-described machine operation.

DETAILED DESCRIPTION OF THE PREFERRED EMBODIMENT

A specific embodiment incorporating the principles of the invention is herewith described with reference to the accompanying drawings. In accordance with the invention, the described system is for applying a spiral coil, which may be made of plastic or metal wire, through the prepunched holes along a side edge of a stack of sheets, which sheets are of a uniform size, but may include some thicker or different material sheets, for example as covers on the top and bottom of the stack. The product of the machine is a spirally bound sheet stack such as is commonly known and recognized in the art.

Figure 1:
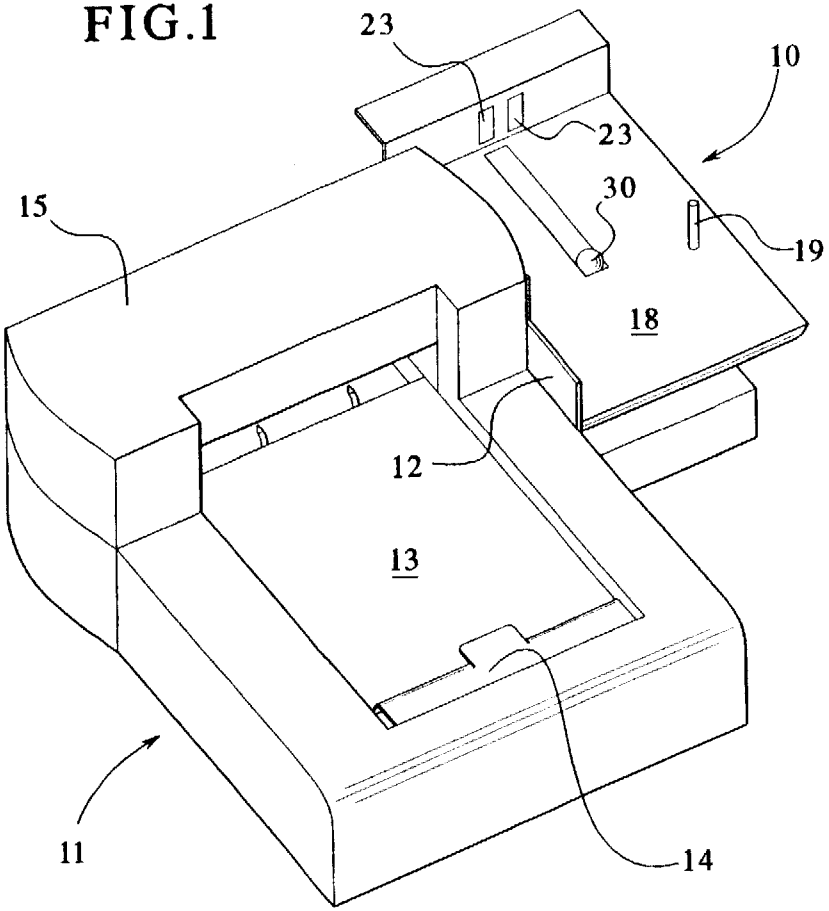
FIG. 1 is a perspective view of a spiral binding system incorporating the principles of this invention.

Referring first to FIG. 1, a spiral binding system can be seen to have a coil loader 10 which is positioned proximate a combined sheet stack positioning and coil binding machine 11. The loader 10 and machine 11 are intended to have flat bases for placement together on a table top. A mounting plate 12 serves to connect the loader 10 with the machine 11. The machine 11 has, at its front, an exposed platform 13 with a simple clamp device 14 at the forward edge thereof and a rearwardly facing free edge. The platform 13 is translatable. Upstanding at the rear of the machine 11 is a relatively raised housing 15, defining an opening toward which the prepunched holes side edge of the stack of sheets is placed for coil binding. A suitable on/off switch, not shown, would be located on the machine to electrically energize conventional electric drive motors and microprocessor control system using well-known encoders as part of a kinematic drive system for bringing about and sequencing the operating movements in the machine. An exemplary mechanical arrangement of shafts, pulleys, gears, and electric rotary motors is shown in the attached drawings for bringing about the intended operational movements of the machine; however, it is recognized and will be appreciated that any suitable driver system would be within the engineering purview of those skilled in the art to bring about the intended movements without departing from the scope and spirit of the invention.

It is the intention of this invention, as will be appreciated by those skilled in the art in contemplating this invention description, that the sheet stack positioning and coil binding machine 11 can be operated apart from association with the coil loader 10. A different or less mechanized approach for coil loading, such as a manual single feeding of coil elements, could be used instead. However, the preferred contemplated use of the machine 11 is in association with the coil loader 10, hereinafter described.

Figure 2:
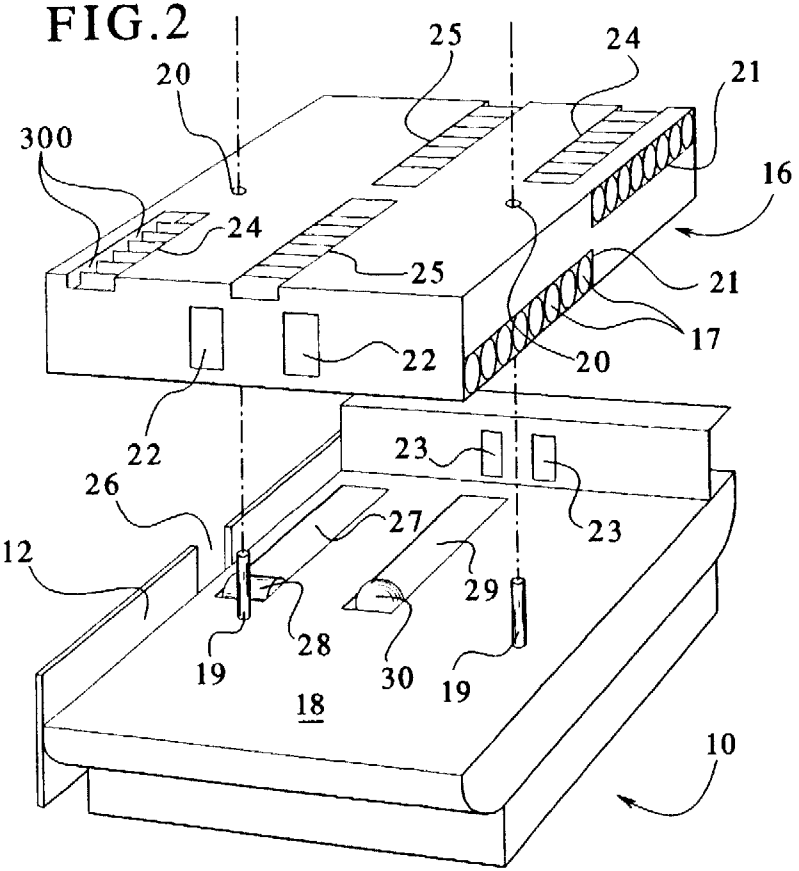
FIG. 2 is a perspective view of a coil loader and associated coil supply cartridge incorporating the principles of the invention.

The purpose of the loader 10 is to enable the system to contain a multitudinous supply of like-size spiral coils, such as for repetitive spiral binding operations, and to cause a single coil to be extracted from the supply for application to a respective sheet stack. With reference to FIG. 2, a box-like cartridge 16 is prepacked to contain a number of individual spiral coils 17, each of which is a pre-cut length defined by a plurality of substantially equally spaced spiral turns thus producing a linear element having a longitudinal axis about which the coil spirals. The box 16 is sized and shaped to fit onto a tray 18 formed in the loader. A set of pins 19 are upstanding from the tray, and the box 16 is formed with a corresponding set of holes 20 such that the box can be positioned onto the set of pins 19 and thus registered upon the tray 18. As a preferred embodiment, the box 16 contains two vertical layers, and two horizontal sections in each layer. An exit opening 21 is provided on a side of the box for each set of coils contained in a partitioned section. The exit openings 21 are kittycorner from each other on each side of the box between the two layers of coil supplies. At the opposed front and back ends of the box 16, there are a pair of barcode labels 22, which will be read by a pair of barcode readers 23 positioned at one end of the tray 18. This barcode labeling serves to designate the particular size, preferably in terms of diameter, of the coils contained in the cartridge box 16, which information will be used to set certain movements or positioning within the drive system as further discussed below. Each of the top and bottom surfaces of the box 16 is provided with an exterior opening 24 and a further exterior opening 25. The opening 24 coincides in length with the exit opening 21, both exposing the full complement of coil storage rows available for that coil section. The opening 25 is one empty space greater in length than opening 24. Because the cartridge box 16 is arranged to carry a quadruple supply of coils 17 for use in the machine, each quadrant supply of coils within the box 16 can be accessed in the loader by virtue of the operator turning the box around front-to-back, turning the box upside down, and then again turning the box front-to-back.

The tray 18 is supported on a suitable translatable mover mechanism for indexable forward and rearward movement, relative to the machine, operated by a suitable electric motor arrangement. Within the mounting plate 12 facing the machine 11 is a cut-away to define a feed opening 26 which coincides with the exit opening 21 exposing the ends of the quadrant supply of coils 17. There is a cut-out 27 formed in the tray 18 which coincides with the opening 24 of the cartridge box situated on the tray. This tray cut-out 27 is proximate the feed opening 26. Positioned within the cut-out 27 and protruding upward from this cut-out for engagement with the spirals of a respective coil exposed by the opening 24 is a rotatably driven feed roller 28, preferably made of rubber. The rotational axis of the feed roller 28 is parallel to the longitudinal axes of the coils. On the other side of the tray cut-out 27 from the feed opening 26 is a parallel cut-out 29 in the tray, which cut-out coincides with the opening 25 when the box is positioned on the tray. Each of the cut-outs 27 and 29 are of a length equal to that of the opening 25. Aligned with the feed roller 28 crosswise of the tray 18, is a raised sensing switch 30, preferably in the form of a ball switch, which normally extends upward protruding through the tray cut-out 29 in its open position, but which is depressible to a lowered position upon engagement by a coil through the opening 25, causing the sensing switch to close.

With the cartridge box suitably positioned on the tray 18 of the loader 10, the loader operates as follows when the machine is turned on. The tray 18 is indexed to a full forward position, such that the lead coil in the cartridge box quadrant being accessed will be that coil proximate the far end of the box as viewed in FIG. 2. The tray 18 is subsequently intermittently indexed rearward for delivering a coil at a time, as needed, until the vacant space in cut-out 25 overlies the sensing switch 30, whereupon the loader 10 ceases operation (preferably signaling a spent condition), and replenishment (by turning or replacing the cartridge box) and re-starting the loader is necessary.

It is contemplated to program the microprocessor control of the system drive for a delay in halting the rearward indexing movement of the tray 18 despite the presence of a coil closing the sensing switch 30, in order to more properly position larger size coils relative to the feed roller 28 and feed opening 26. Such a delay instruction would be triggered by the information read from the barcode label 22. However, essentially speaking, when the loader is signalled to operate, the tray 18 moves rearward until stopped by a coil overlying the sensing switch 30. This coil then also overlies the feed roller 28. The feed roller then rotates, contacting the outside diameter of the coil and spirally feeding the coil endwise out of the cartridge box through the feed opening 26. In order to enable feed roller rotation to translate the coil out through the feed opening 26, one or more stationary cross rails 300 extending outwardly from the cartridge box interior and transversely of the longitudinal axis of the coil is situated in the cartridge box 16 on either side of the cut-out opening 24 in each coil channel. Each cross rail 300 protrudes partially into the path of coil withdrawal through the feed opening 26, and is disposed between spiral turns in the coil. Preferably, the cross rails 300 are formed as part of a plastic-molded channel structure for individually containing the coils in the box 16 in contiguous longitudinal rows. The stationary cross rails 300 in the cartridge box 16 act as a thread in conjunction with the spiral of the coil during feed roller 28 engagement and rotation of the coil, akin to a stationary nut and bolt.

Figure 3:
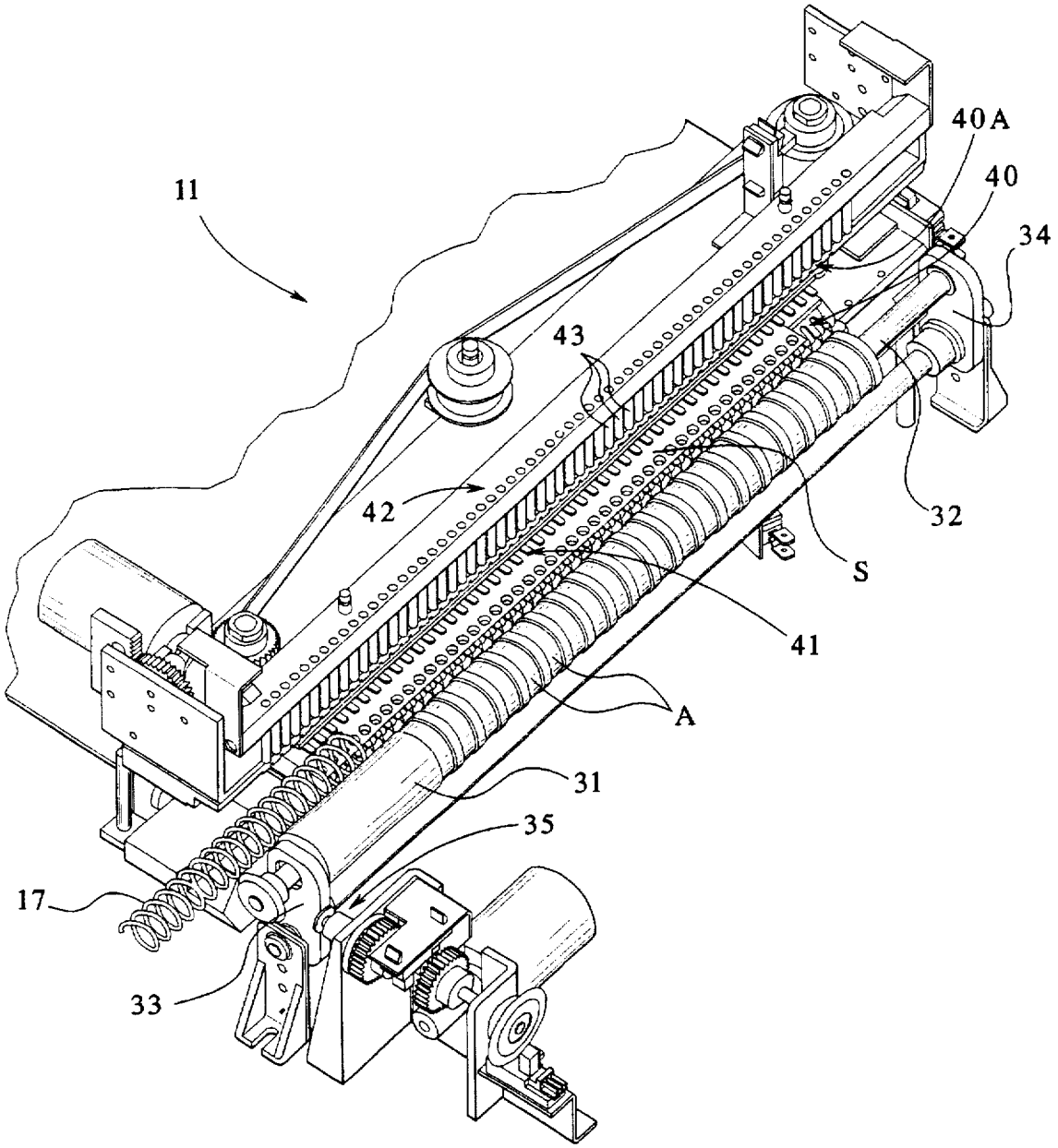
FIG. 3 is a partial perspective view showing the coil guide and rotatable drive roller aspects of the spiral binding machine incorporating the principles of the invention.

With reference to FIG. 3, the back end of the machine 11 is formed with a coil guide mechanism and driver. The purpose of the coil guide mechanism is to properly position and support the spirals of the coil received from the loader 10 for ease of insertion into the prepunched holes along the side edge of the stack of sheets being bound; and the purpose of the driver is to spirally conduct the coil lengthwise through the coil guide. The driver is in the form of a elongated roller 31, which is preferably formed with a series of reliefs A spaced apart along the length of the driver roller. The driver roller 31 is suitably geared for rotational movement on a shaft 32 which is journaled for rotation at opposed ends in supports 33 and 34. The drive roller 31 engages with the outer diameter of the spirals of the coil fed from the loader 10 and is initially rotated in a direction for spirally feeding the coil lengthwise through the coil guide. The rotational engagement of the drive roller 31 on the coil 17 is preferably not continuous, however. In order to simulate the action of human intervention in the binding of spiral coils, a pulse action has been added to the operation.

The interval between pulses and the amount pressure engagement of the drive roller 31 on the coil 17 can be set for control by the drive system dependent upon the size of the coil, as read by the barcode reader in the loader 10. The pulsing action is brought about this way. The driver roller shaft supports 33 and 34 are pivotable. A reversible screw drive 35 is connected to support 33 to tilt the support back and forth, and also may be used to adjust roller pressure on the coil at intervals, preferably increasing the pressure during the pulse action on the coil as the coil progressively winds through the punched holes in the sheet stack. As further discussed below, it will also be noted that screw drive 35 is used to press the drive roller against the coil to hold the coil when its ends are being crimped.

The coil guide mechanism is composed of a plurality of subsystems in which guide plates with blind slots are used. First, there is a lower guide plate 40, which is stationary and which underlies the prepunched holes side edge of the sheet stack to be bound by the coil. The guide plate 40 defines a series of slanted recess slots opened toward and receiving the coil 17 as the coil is fed by the drive roller 31. The guide plate 40 extends lengthwise, parallel to the lengthwise rotational axis of the drive roller 31. A second guide plate 40A is positioned on the machine 11 in overlying relationship to the stationary guide plate 40. This upper guide plate 40A is formed, on its bottom surface, also with a series of slanted recess slots, mirroring such slots in the lower guide plate 40. The slots of guide plate 40A are also opened toward and for receiving the coil 17 as the coil is fed by the drive roller 31. This upper guide plate 40A translates vertically, its positioning being set by the drive system and varying dependent upon coil size. Thus, when binding larger sheet stacks, and hence utilizing a relatively larger coil size, the position of the upper guide plate 40A is changed from a nominal overlying position to a higher position, through an appropriate microprocessor controlled level setting mechanism, to avoid clamping pressure on the sheet stack and allow the larger coil to spiral through the prepunched holes more freely.

Still further, the movement of the upper guide plate 40A may be utilized to perform two additional functions, aside from guiding the coil spirals, in conjunction with the sheet stack positioning and coil crimping mechanisms described below. Thus, before proceeding to its assigned vertical disposition for guiding the particular size coil being used to bind the sheet stack, the upper guide plate 40A is first fully lowered onto a sheet stack, which has been delivered into the back end of machine 11, to the point of stall. A suitable coder connected to the drive system associated with the upper guide plate thereby senses the thickness of the sheet stack. This thickness measurement is then correlated with the size of the coil, determined from the bar code 22 on the cartridge box 16, in the microprocessor. If the coil size is inappropriate, there could be a suitable LCD display fitted on the machine 11 to give the operator this information in the form of an error message. The other additional function is to have the upper guide plate's drive system become activated again upon the coil crimping steps described below, whereby the guide plate would be lowered into engagement with the outer diameter of the coil to assist in clamping the coil during coil crimping.

Extending downwardly from a recessed section in the bottom surface of the upper guide plate 40A and disposed forwardly and away from the upper guide plate slots, there may be provided a loosely disposed or spring biased presser element 41 for pressing on the top of the sheet stack during the coil binding operation of the machine 11. The presser element 41 is shown in the form of a lengthwise series of presser feet. This element 41 dangles beneath the upper guide plate 40A, and is lowered onto the top of the sheet stack, to provide a stabilizing force on the sheet stack, when the upper guide plate 40A is lowered into operating position. When the upper guide plate 40A is withdrawn upwardly for withdrawal of a coil-bound sheet stack from the machine 11, the presser element 41 is likewise raised off the sheet stack.

In addition to the stationary guide plate 40 and the vertically movable guide plate 40A, the coil guide mechanism includes an auxiliary bar 42 which is likewise elongated and extending lengthwise and parallel with the rotational axis of the drive roller 31, and which overlies the upper guide plate 40A. The elongated bar 42 is formed with a series of spaced-apart downwardly directed pins 43, thereby defining slots in between the pins which are used to guide the spirals of the coil. The bar 42 is supported by a suitable vertical positioning mechanism, the bar position being set by the drive system toward and away from the prepunched holes side edge of the sheet stack, depending upon the size of the coil 17 being used. This auxiliary guide bar 42 is employed to prevent the relatively larger spiral coils from twisting out of the upper guide plate slots during the spiral feeding operation of the drive roller 31. This auxiliary guide bar 42 and its downwardly extending pins is preferably positioned out of the way and not used for guiding relatively smaller size coils.

Figure 4:
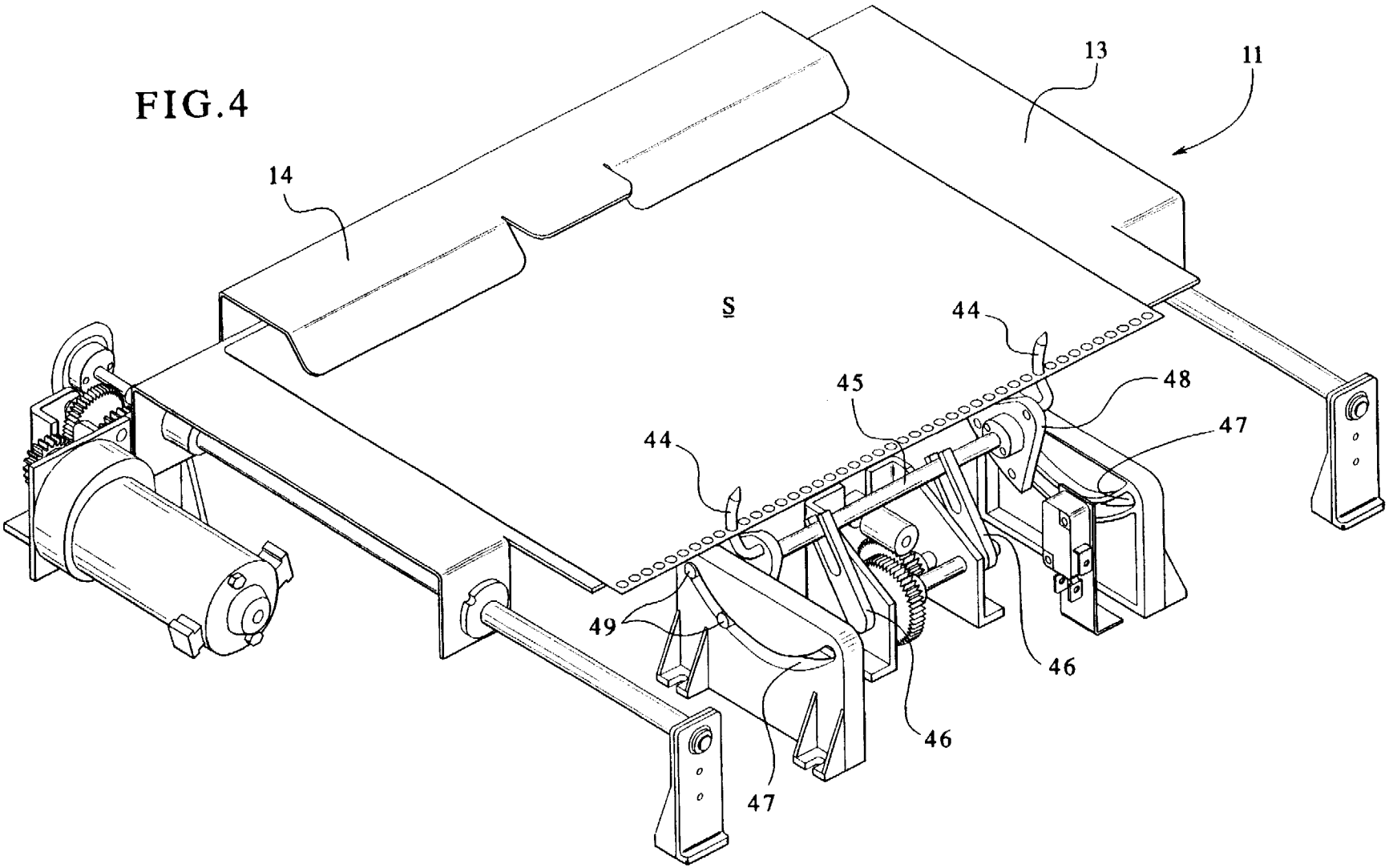
FIG. 4 is a perspective view showing the sheet stack positioner aspect of the spiral binding machine incorporating the principles of the invention.

FIG. 4 depicts the sheet stack positioning mechanism located at the front end of the machine 11. The purpose of the sheet stack positioning mechanism is to accurately locate the stack of sheets (see S in FIG. 4) with its prepunched holes lengthwise aligned with the coil guide, so that the spirals of the coil can appropriately and sequentially be driven through the holes for binding the stack. It has been noted that the binding process on relatively thick sheet stacks is eased if the prepunched holes side edge of the stack is shifted into a curved shape mimicing the curvature of the coil. The stack positioning mechanism utilizes a pair of curved locating pins 44 to do this.

The sheet stack S is loaded into the apparatus by placing the sheet stack to be bound at an appropriate spot on the platform 13. The prepunched holes side edge of the stack is passed over the pins 44 and extends just beyond the edge of the platform 13. The prepunched holes side edge of the stack is shifted into a curved shape which mimics the shape of a coil; and the pins serve to register the stack on the platform 13. The retaining clamp 14 is then lowered onto the opposed edge of the sheet stack. The curved pins 44 project vertically upward from respective ends of a support rod 45, the disposition of which is controlled by the movement of pivotable arms 46 and by cam grooves 47. As illustrated in FIG. 4, the ends of the support rod 45 are fitted with plates 48 from which cam follower pins 49 project into the cam grooves 47. This arrangement causes the plates 48, and thus the support rod 45 and curved pins 44, to rotate when the support rod is translated to and fro by movement of the arms 46. The arms 46 are driven for back and forth pivoting movement by a suitable rotary shaft reversible drive system.

Thus, when the machine has been loaded with a sheet stack and is turned on, the drive system associated with the curved pins 44 is activated to pivot the arms 46 rightward from their position shown in FIG. 4, causing the curved pins 44 to rotate out from the prepunched holes of the stack and recede beneath the platform 13. The curved pins 44 will again be returned to their upraised position, as shown in FIG. 4, through re-activation and reverse operation of the subject drive system, after the machine binding sequence has been completed and the translatable platform 13 returned to its exposed starting position, as shown in FIG. 4.

When the machine has thus been loaded with a sheet stack, turned on, and curved pins retracted beneath the stack platform 13, and sheet stack S, are passed rearward in the mechanism 11 toward the coil guide and driver mechanisms. The platform 13 is supported for translatable movement, as shown in FIG. 4, via a suitable screw drive system mechanism. The precise stopping point for rearward movement of the platform 13, and the associated sheet stack S, is controlled by the drive system, via its microprocessor, depending upon the coil size being used. Accordingly, the final disposition point for the prepunched holes side edge of the stack to be bound correlates with the coil size delivered from the loader 10, as determined by the barcode reader in the loader 10.

Figure 5:
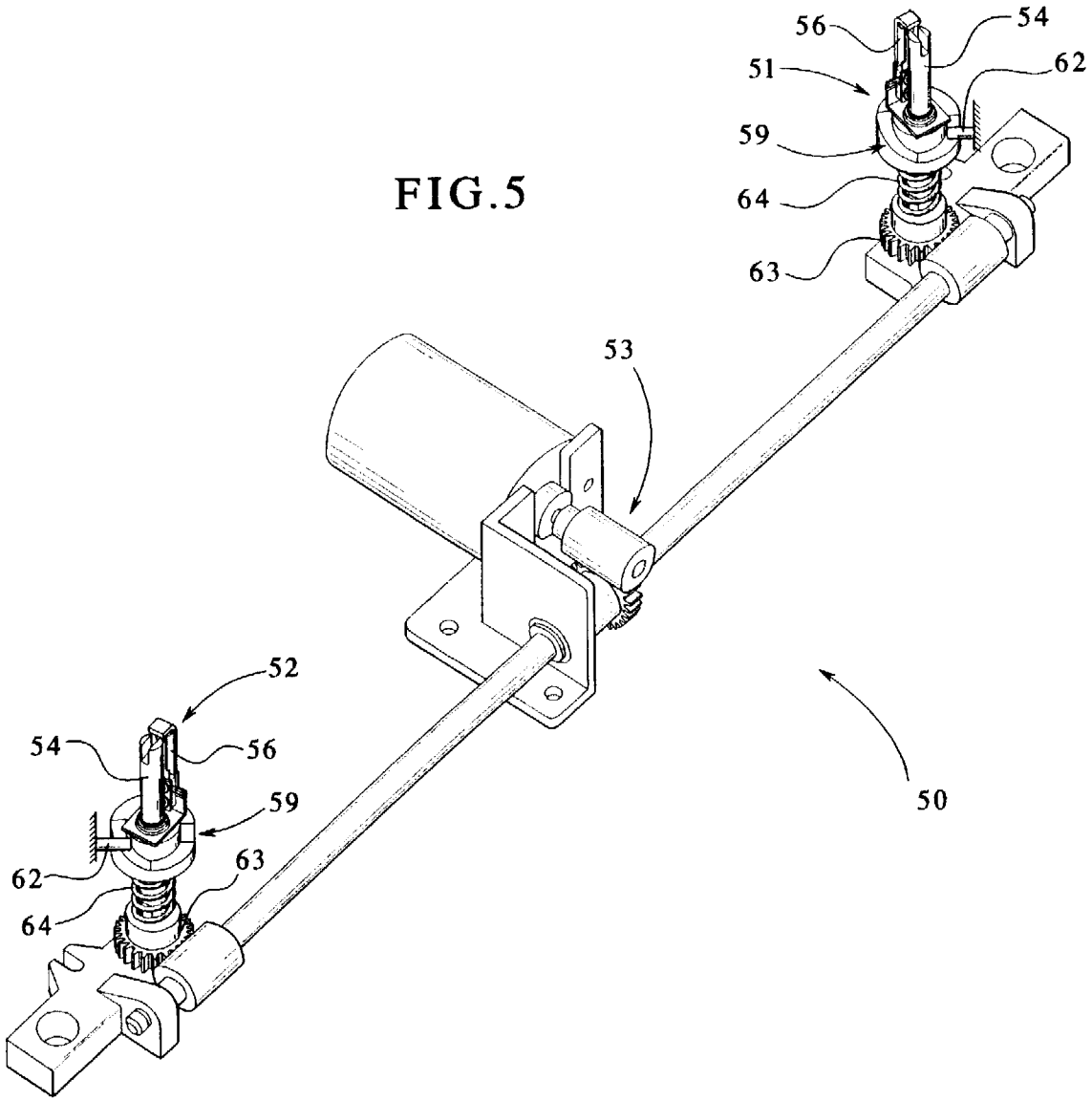
FIG. 5 is a perspective view showing the coil crimper elements aspect of the spiral binding machine incorporating the principles of the invention.

Not shown in FIG. 3, but illustrated in FIG. 5 is a coil crimp mechanism 50 disposed in the coil binding mechanism 11 generally underlying the stationary guide plate 40. The coil crimp mechanism sequentially operates a pair of coil crimpers 51 and 52, via a suitable kinematic mechanisms powered by an electric motor-driven reversible drive 53. The purpose of the coil crimp mechanism 50 is to cause the ends of the coil which have been wound through the prepunched holes of the sheet stack to permanently deform so that the coil cannot back out of the prepunched holes side edge. The crimpers 51 and 52 are thus situated at opposed ends of the guide plate 40.

Figure 6:
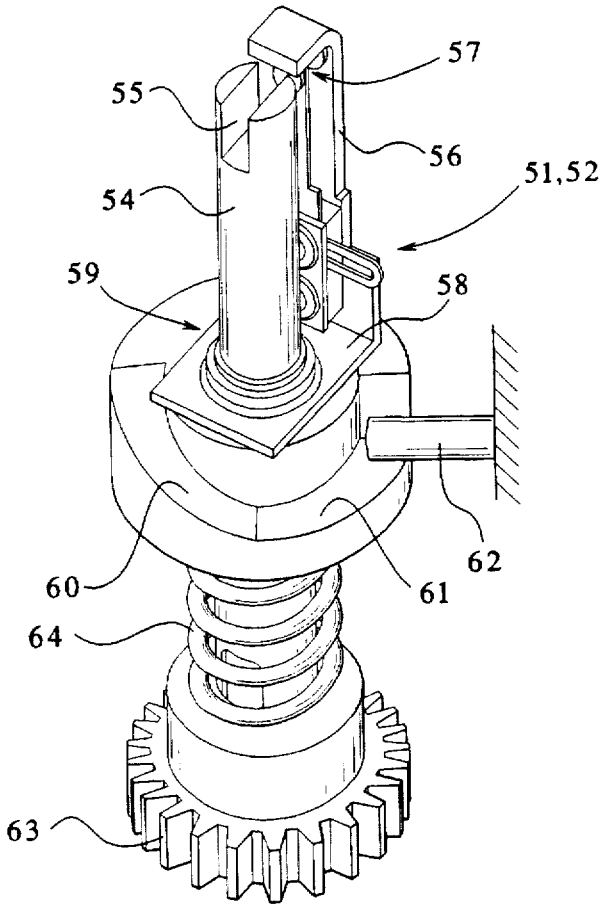
FIG. 6 is a perspective view showing a coil crimper element for use in the spiral binding machine incorporating the principles of the invention.

With specific reference to FIG. 6, each of the coil crimpers 51 and 52 is configured with a post 54, extending along an upright axis and formed at its upper end with a through slot 55. Immediately behind one end of the through slot 55 is an upright frame member 56 along which is mounted a limit switch 57 exposed to the through slot 55. The frame 56 is fitted with a base 58, which loosely encompasses the post 54 and through which the post 54 extends. Fixed at this midway point on the post 54 is a cylindrical cam 59. The cam 59 encompasses the post, and has carved arcuately into approximately half its circumference a cam follower surface composed of a ramp section 60 and a lower end horizontal section 61. The base 58 of the upright frame member 56 is supported on the top of the cam 59. A stationary member 62, which may be in the form of a roll bar or other suitable member, is provided to track the cam follower sections 60 and 61. Beneath the cam 59, the lower end of the post 54 is suitably connected, such as by a spline connection, for rotational movement with a driven gear 63, as well as for translational movement relative thereto. Between the gear 63 and the bottom surface of the cam 59 is a spring bias, such as in the form of a coil spring 64 circling the lower end of the post 54, arranged to urge the cam 59 upwardly. The vertical disposition of the cam 59, carrying the post 54 and frame member 56, is thus controlled by the relative position of the stationary member 62 along the cam follower sections 60 and 61.

The degree of translatable movement of the post 54 during the actual crimping operation is controlled by the amount of rotation given the gear 63 during that operational step. The microprocessor sets the drive system for the crimpers to control that amount of rotation depending upon the size of the coil being used for binding, which information has been received by the microprocessor through the barcode reader. A conventional encoder disk may be fitted to the gear 63 or post 54 to permit the microprocessor to control the amount of shaft rotation during the actual crimping operation.

Figure 7:
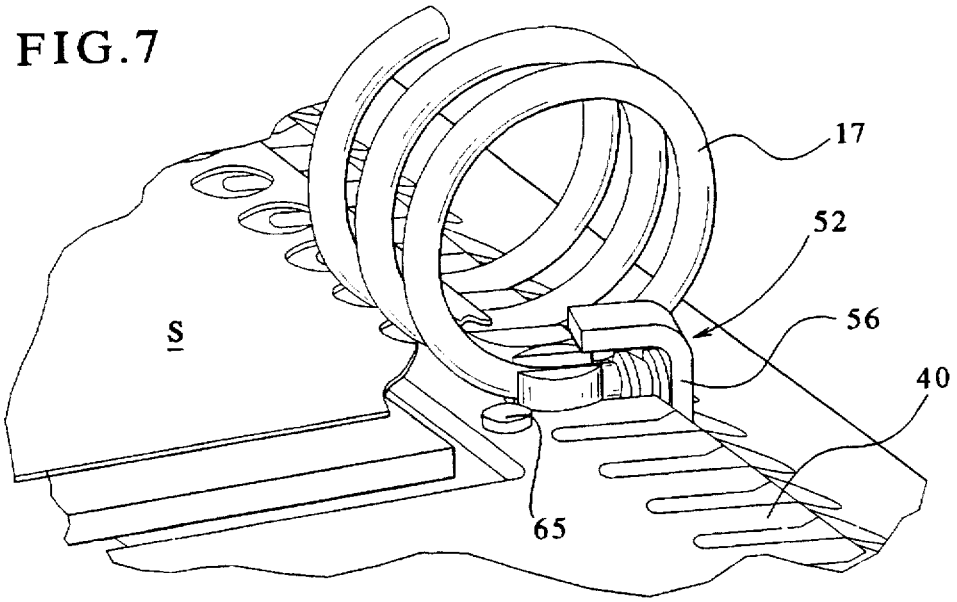
FIG. 7 is a partial perspective view showing the tail end coil crimper element upraised to its operative position.

FIG. 7 illustrates, with coil crimper 52, how the coil crimper is located on the guide plate 40, and in its raised position to receive a free end of the coil after the coil has been threaded through the prepunched holes of the sheet stack S. Not shown in FIGS. 5 and 6 but depicted here is that a stationary, low-lying post 65 is fitted on the guide plate 40 adjacent and slightly offset from coil entrance area into the crimper. Such a post 65 is associated with each crimper to serve as a stop or anvil against outward spreading movement of the coil as its free end is turned and deformed by the action of the crimper.

Turning back again to FIG. 5, the coil crimp mechanism 50 and the coil crimping operation are now described. After the lead end of the coil has been driven through the prepunched holes of the sheet stack, this lead end then runs into the post through slot 55 of the raised crimper 51 and engages the limit switch 57 on that crimper. When the lead end of the coil contacts the crimper limit switch 57, rotation of the drive roller 31 is stopped; and the upper coil guide plate 40A is caused to lower a prescribed amount, controlled by the microprocessor dependent upon the barcode read coil size, and the screw drive 35 operates with the pivotal support 33 to pivot the drive roller 31 rearwardly, both for pressing engagement against the outer diameter of the length of the coil. These movements of the upper coil guide plate 40A and the drive roller 31 serve to clampingly retain the coil in preparation for the crimping operation. The lead end crimper 51 now has its post 54 rotate and simultaneously descend, thus crimping the lead end of the coil as the upper end of the post 54 passes beneath the plane of the stationary coil guide plate 40 and so releases the coil.

As the lead end crimper 51 is descending, the other crimper 52, disposed along the stationary guide plate 40 adjacent the lower punched holes side edge of the sheet stack and in line with the tail end of the coil now having been driven past the tail end crimper 52, has its post 54 and frame 56 arrangement rotated and raised to a suitable position upstanding from the stationary guide plate 40. The upper coil guide plate is raised and the screw drive 35 for the drive roller 31 acts on the support arm 33 to tilt back the drive roller 31 into its appropriate feed rotation position. The drive roller rotation reverses, and the coil is spirally fed backwards through the prepunched holes side edge of the stack until the tail end of the coil passes into the through slot 55 of the crimper 52 and engages that crimper's limit switch 57. The closing of the limit switch 57 in the tail end crimper again causes the upper coil guide plate 40A to lower and the drive roller 31 to be pivoted forward for retaining the coil for a tail end crimping operation. The tail end crimper post 52 now appropriate rotates and descends as it crimps the tail end of the coil. At the same time, the lead end crimper 51 has its post 54 rotated and raised, in an adjusted fashion, to the appropriate position for awaiting the next coil binding operation. When the tail end crimper 52 has descended beneath the plane of the lower coil guide plate 40, the upper coil guide 40A raises and the screw drive 35 tilts back the drive roller 31 to their appropriate positions in preparation for a further coil binding operation.

The sheet stack S is now bound by a spiral coil, having deformed lead and tail ends so the coil cannot back out of the stack. The drive system then causes the stack positioning platform 13 to withdraw out to its starting point where the operator can undue the clamp plate 14 and remove the coil bound stack from the machine, the point shown in FIG. 4. As those skilled in the art will appreciate, the loader 10 and coil binding machine 11 cycle through the above-described steps each time the operator activates the machine to cause a sheet stack having prepunched holes along one side edge to be bound with a spiral coil.

Although the present invention has been described with reference to a specific embodiment, those of skill in the art will recognize that changes may be made thereto without departing from the scope and spirit of the invention as set forth in the appended claims.

We claim as my invention:

1. An automated machine for spirally binding a stack of sheets having prepunched holes along a side edge thereof, said machine comprising:

a coil guide defining a lengthwise series of slots for positioning the spirals of a coil;

a rotatable drive roller for engaging said coil and spirally feeding said coil lengthwise through said coil guide;

a stack positioner movable relative to said coil guide while holding the stack of sheets, wherein said stack positioner accurately locates said stack of sheets with its prepunched holes lengthwise aligned with said coil guide, such that the spirals of said coil sequentially pass through the prepunched holes as said coil is fed along said coil guide;

a pair of coil crimpers, one for deforming the lead end of said coil after it has passed through the prepunched holes of said stack of sheets and the other for deforming the tail end of said coil; and a drive system for operating movements in said machine.

2. The automated machine of claim 1, wherein said drive system pulses engagement of said drive roller on said coil.

3. The automated machine of claim 2, wherein the interval between pulses and amount of pressure engagement of said drive roller on said coil is controlled by said drive system dependent upon size of said coil.

4. The automated machine of claim 3, wherein said drive roller is elongated about a rotary shaft, said shaft is supported at opposed ends on pivotable supports, and a reversible screw drive is connected to one said support to tilt said support back and forth.

5. The automated machine of claim 2, wherein said drive roller is elongated about a rotary shaft and formed with a series of reliefs spaced apart along the length of said driver roller.

6. The automated machine of claim 1, wherein said drive roller is disposed for pivotable movement by said drive system transversely of its axis of rotation, and wherein said drive system ceases rotation of said drive roller and causes pivoting of said drive roller into retaining engagement of said coil when at least one of said lead and tail ends of said coil is being deformed by said respective crimper.

7. The automated machine of claim 1, wherein at least one said coil crimper comprises a post having a slotted upper end and being rotatable by said drive system about an axis transverse to the feed direction of said coil through said coil guide.

8. The automated machine of claim 7, wherein said at least one coil crimper is disposed for axially translatable movement by said drive system during rotation of said post.

9. The automated machine of claim 1 or 6, wherein at least one said coil crimper comprises a post having a slotted upper end and which is disposed for simultaneous rotational and translatable movement by said drive system, such that the respective end of said coil is driven into said post slot by rotation of said drive roller and then said drive system causes said post to rotate and descend whereby said post crimps and releases the respective end of said coil.

10. The automated machine of claim 9, wherein the degree of translatable movement of said post is controlled by said drive system dependent upon size of said coil.

11. The automated machine of claim 1, wherein said stack positioner comprises a platform, supported for translatable movement by said drive system toward and away from said coil guide, for carrying said stack of sheets and a plurality of locating pins adjacent one edge of said platform and disposed for movement by said drive system between a raised position upstanding from said platform, when said platform is away from said coil guide, and a lowered position beneath said platform, when said platform is moved toward said coil guide.

12. The automated machine of claim 11, wherein said locating pins have curved upper surfaces, such that corresponding prepunched holes in said stack of sheets pass over said locating pins to locate said stack on said platform and shift the prepunched holes side edge of said stack into a curved shape mimicing the curvature of said coil.

13. The automated machine of claim 11 or 12, wherein the extent of translatable movement of said platform toward said coil guide is controlled by said drive system dependent upon size of said coil.

14. The automated machine of claim 1 or 11, wherein said coil guide comprises an elongated plate defining a series of recess slots open toward said coil as said coil is fed by said drive roller, said plate disposed in overlying relationship to said prepunched holes side edge of said stack when said stack is located by said stack positioner for sequential passing of the spirals of said coil through said prepunched holes.

15. The automated machine of claim 14, wherein said plate is disposed for variable translatable movement by said drive system toward and away from said prepunched holes side edge of said stack to a stationary position, said stationary position being set by said drive system dependent upon size of said coil.

16. The automated machine of claim 15, wherein an elongated bar overlying said plate is formed with a series of pins downwardly directed toward said coil as said coil is fed by said drive roller, said bar being disposed for translatable movement by said drive system toward and away from said prepunched holes side edge of said stack to a stationary position, said stationary position being set by said drive system dependent upon size of said coil.

17. The automated machine of claim 16, wherein the disposition of said pins on said bar is such that said pins only interact with large coil sizes which may tend to twist out of said coil guide when said large coils are spirally fed through said coil guide, as opposed to smaller coil sizes which tend not to twist out of said coil guide.

18. The automated machine of claim 14, wherein said coil guide includes a further elongated plate defining a series of recess slots, said further plate being stationary and disposed in underlying relationship to said prepunched holes side edge of said stack when said stack is located by said stack positioner for sequential passing of the spirals of said coil through said prepunched holes.

19. The automated machine of claim 1, wherein said coil guide comprises an elongated bar disposed in overlying relationship to the prepunched holes side edge of said stack when said stack is located by said stack positioner for sequential passing of the spirals of said coil through said prepunched holes, said bar having a series of spaced pins facing downward toward said coil as said coil is fed by said drive roller.

20. The automated machine of claim 19, wherein said bar is disposed for variable translatable movement by said drive system toward and away from said prepunched holes side edge of said stack to a stationary position, said stationary position being set by said drive system dependent upon size of said coil.

21. The automated machine of claim 20, wherein the disposition of said pins on said bar is such that said pins only interact with large coil sizes which may tend to twist out of said coil guide when said large coils are spirally fed through said coil guide, as opposed to smaller coil sizes which tend not to twist out of said coil guide.

22. The automated machine of claim 1, further including a coil loader having a rotatable feed roller, operated by said drive system, for spirally feeding said coil from a multitudinous coil supply to said coil guide.

23. The automated machine of claim 22, wherein said multitudinous coil supply is in the form of a prepacked cartridge set of coils.

24. The automated machine of claim 22, wherein said coil loader comprises a tray, for carrying said coil supply, supported for translatable movement by said drive system to bring said coil into feeding relation with said feed roller.

25. The automated machine of claim 24, further including a coil sensor for detecting the availability of said coil to be fed by said feed roller.

26. The automated machine of claim 24 or 25, wherein said coil supply is contained in a cartridge box sized and shaped for placement on said tray, said box being formed with an exterior cut-out section enabling a portion of said coil to engage with said coil sensor.

27. The automated machine of claim 26, wherein said box is partitioned to contain separate respective coil supplies, each partitioned section having a respective said cut-out section associated therewith.

28. The automated machine of claim 27, wherein certain respective coil supplies are overlying other respective coil supplies.

29. A method of spirally binding a stack of sheets comprising such process steps as are performed by the apparatus of claim 1, 6, 11, or 22.

30. A spirally bound stack of sheets produced by the method of claim 29.

* * * * *